US008091649B2

(12) United States Patent
Kosuge et al.

(10) Patent No.: US 8,091,649 B2
(45) Date of Patent: Jan. 10, 2012

(54) PNEUMATIC SCREW DRIVER AND STOP CONTROL METHOD FOR AIR MOTOR IN PNEUMATIC SCREW DRIVER

(75) Inventors: Makoto Kosuge, Tokyo (JP); Masaki Haruta, Tokyo (JP)

(73) Assignee: Max Co., Ltd., Tokyo (JP)

( * ) Notice: Subject to any disclaimer, the term of this patent is extended or adjusted under 35 U.S.C. 154(b) by 196 days.

(21) Appl. No.: 12/498,584

(22) Filed: Jul. 7, 2009

(65) Prior Publication Data

US 2010/0012341 A1 Jan. 21, 2010

(30) Foreign Application Priority Data

Jul. 18, 2008 (JP) ..... 2008-187144

(51) Int. Cl.
*B25B 23/00* (2006.01)

(52) U.S. Cl. ..... 173/1; 81/57.44; 173/218; 173/11

(58) Field of Classification Search ..... 173/141, 173/148, 149, 213, 216–222; 227/8; 81/57.44, 81/57.37, 429, 469, 470
See application file for complete search history.

(56) References Cited

U.S. PATENT DOCUMENTS

| | | | | |
|---|---|---|---|---|
| 5,921,156 | A * | 7/1999 | Takezaki et al. | 81/57.13 |
| 6,073,521 | A * | 6/2000 | Uno et al. | 81/57.44 |
| 6,205,894 | B1 * | 3/2001 | Tanaka | 81/470 |
| 7,677,426 | B2 * | 3/2010 | Tillinghast et al. | 227/130 |

FOREIGN PATENT DOCUMENTS

| | | |
|---|---|---|
| JP | 2001-353671 | 12/2001 |
| JP | 3570491 | 7/2004 |

* cited by examiner

*Primary Examiner* — Rinaldi Rada
*Assistant Examiner* — Andrew M Tecco
(74) *Attorney, Agent, or Firm* — Drinker Biddle & Reath LLP

(57) ABSTRACT

A pneumatic screw driver includes: a tool body; a nose portion; a main air chamber; a hammering cylinder; a driver bit integrally combined with a hammering piston in the hammering cylinder; an air motor; a valve housing provided in an air passage between the main air chamber and the air motor; a stop valve piston provided in the valve housing; a stop valve stem coaxially provided with the stop valve piston; a timer chamber connected to the hammering cylinder; a first pipeline and a second pipeline respectively formed at upper and lower positions in a lower portion of the stop valve stem; and a upper end proximal portion of a contact member provided slidably in a driving direction. The upper end proximal portion of the contact member is provided engageably with the stop valve stem. The first pipeline and the second pipeline are arranged so as to close the first pipeline after closing the second pipeline by moving the stop valve stem upward from a bottom dead center.

4 Claims, 8 Drawing Sheets

PNEUMATIC SCREW DRIVER AND STOP CONTROL METHOD FOR AIR MOTOR IN PNEUMATIC SCREW DRIVER

This application claims priority from Japanese Patent Application No. 2008-187144, filed on Jul. 18, 2008, the entire contents of which are hereby incorporated by reference.

FIELD OF THE INVENTION

The present disclosure relates to a pneumatic screw driver having a stop mechanism for stopping an air motor at a screw-down position after hammering a drive screw and tightening the drive screw by an air motor. The present disclosure further relates to a stop control method for the air motor in the pneumatic screw driver.

DESCRIPTION OF RELATED ART

Japanese Patent No. 3570491 discloses a related-art pneumatic screw driver. Generally, the related-art pneumatic screw driver is so designed that after a drive screw is lightly driven into a workpiece, the drive screw is screwed down securely. The pneumatic screw driver includes a hammering mechanism for hammering the drive screw and a screw-down mechanism for rotating the drive screw. In the hammering mechanism, a driver bit is integrally combined with a hammering piston accommodated slidably in a hammering cylinder, and a main valve is operated by an operation of a trigger. A main air chamber for storing compressed air is thereby opened and closed with respect to the hammering cylinder so as to supply the compressed air to the hammering cylinder, to thus drive the hammering piston. Meanwhile, the screw-down mechanism rotates the driver bit by using an air motor.

In the related-art pneumatic screw driver, a contact arm is slidably held along a nose portion for ejecting a drive screw, and the contact arm is urged so as to project from the nose portion in a driving direction. The related-art screw driver includes a safety device. In the safety device, when a leading end of the contact arm is pressed against a workpiece, the other end of the contact arm abuts against a contact arm stopper and is locked so as not to move any further, allowing the trigger operation to be effective. Furthermore, the lock of the contact arm by the contact arm stopper is canceled simultaneously with an actuation of the hammering mechanism by the operation of the trigger, and the drive screw is screwed down by the air motor. The related-art pneumatic screw driver further includes an automatic stop mechanism. The automatic stop mechanism controls such that when the drive screw has been screwed down to a given screw-down depth, the air motor is automatically stopped to allow the screw-down depth to become constant.

In the related art pneumatic screw driver, two valves, i.e., an exhaust valve and a stop valve, are respectively arranged on two axes. When the drive screw has become flush with the workpiece, the air motor is stopped by supplying the compressed air to the exhaust valve in consequence of increasing a pressure in a blow-back chamber connected to a main air chamber and by operating a valve stem of the stopper valve by a contact arm.

In the related-art pneumatic screw driver, an L-shaped valve element (an L-shaped metal part with rubber attached to its leading end) is added in addition to the two valves.

However, in the related-art pneumatic screw driver, materials of different kinds, i.e., sheet metal and rubber, are used for assembling the L-shaped valve element. For this reason, the number of parts of the screw driver increases, and source segregation and discarding are troublesome. In addition, since the valves are arranged on the two axes, a structure of the related-art pneumatic screw driver is complicated. Further, a layout of the valves inevitably becomes large, and therefore the cost becomes high.

Patent Document 1: Japanese Patent No. 3570491

Patent Document 2: Japanese Patent Application Publication No. JP-A-2001-353671

SUMMARY OF INVENTION

Illustrative aspects of the present invention provide a pneumatic screw driver whose structure is simple and which reduces the number of parts and makes the layout small, and further provide a stop control method for an air motor in the pneumatic screw driver.

According to an illustrative aspect of the invention, a pneumatic screw driver is provide with: a tool body; a nose portion provided on a leading end of the tool body; a main air chamber which stores compressed air; a hammering cylinder provided in the tool body; a driver bit integrally combined with a hammering piston in the hammering cylinder; an air motor operated by the compressed air; a valve housing provided in an air passage between the main air chamber and the air motor; a stop valve piston provided in the valve housing, the stop valve piston which opens and closes the air passage; a stop valve stem coaxially provided with the stop valve piston, the stop valve stem which causes the stop valve piston to open and close; a timer chamber connected to the hammering cylinder; a first pipeline and a second pipeline respectively formed at upper and lower positions in a lower portion of the stop valve stem; and an upper end proximal portion of a contact member provided slidably in a driving direction in such a manner as to project from the nose portion, the upper end proximal portion provided engageably with the stop valve stem. The first pipeline and the second pipeline are arranged so as to close the first pipeline after closing the second pipeline by moving the stop valve stem upward from a bottom dead center.

Other aspects and advantages of the invention will be apparent from the following description, the drawings and the claims.

DETAILED DESCRIPTION OF EXEMPLARY EMBODIMENTS

Figure 1:
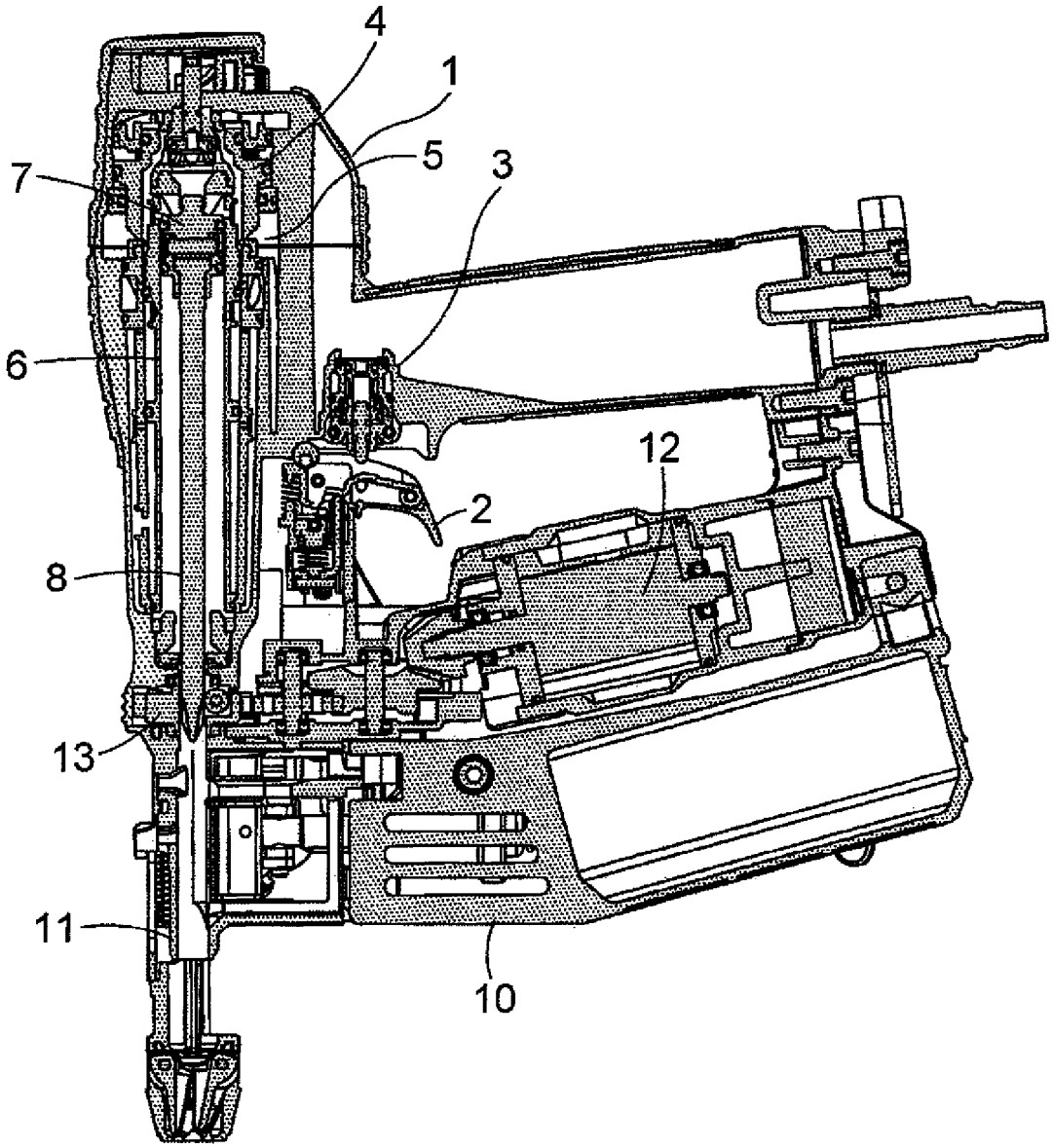
FIG. 1 is a vertical cross-sectional view of a screw driver.

FIG. 1 shows a vertical cross-sectional view of a screw driver. The screw driver includes a hammering mechanism and a screw-down mechanism provided in the interior of a tool body 1. The hammering mechanism includes a hammering cylinder 6, a hammering piston 7 provided slidably in the hammering cylinder 6, and a driver bit 8 connected integrally with the hammering piston 7. As a trigger 2 is operatively pulled, the hammering mechanism actuates a trigger valve 3, and in interlocked relation thereto a main valve 4 is moved upward to undergo an opening operation, which allows compressed air to be supplied into the hammering cylinder 6 from a main air chamber 5 (connected to an air supply source) with compressed air stored therein, thereby causing the driver bit 8 to effect the hammering operation. The screw-down mechanism (not shown) causes the driver bit 8 to effect the tightening operation by the power of an air motor 12. Simultaneously with the operation start of the hammering mechanism, the main valve 4 undergoes the opening operation, and a part of the compressed air which flowed in from the main air chamber 5 is supplied to the air motor 12. As the screw-down mechanism rotates the driver bit 8 about its axis together with a rotary gear 13 fitted slidably to the driver bit 8, a drive screw N hammered by the driver bit 8 is further tightened.

In the screw driver, a contact arm (contact member) 15 is slidably disposed along a nose portion 11 for ejecting the drive screw N. The contact arm 15 functions as a safety device. A leading end of the contact arm 15 is urged so as to project from a leading end of the nose portion 11 in a driving direction, while a portion of the other end portion of the contact arm 15 is located in a vicinity of the trigger 2. The operation of the trigger 2 is effective only when the leading end is pressed against a workpiece P.

The tool body 1 is provided with an automatic stop mechanism for controlling the air motor 12 such that the air motor 12 is automatically stopped after the drive screw N has been screwed down to a given screw-down depth by the screw-down mechanism.

Figure 2:
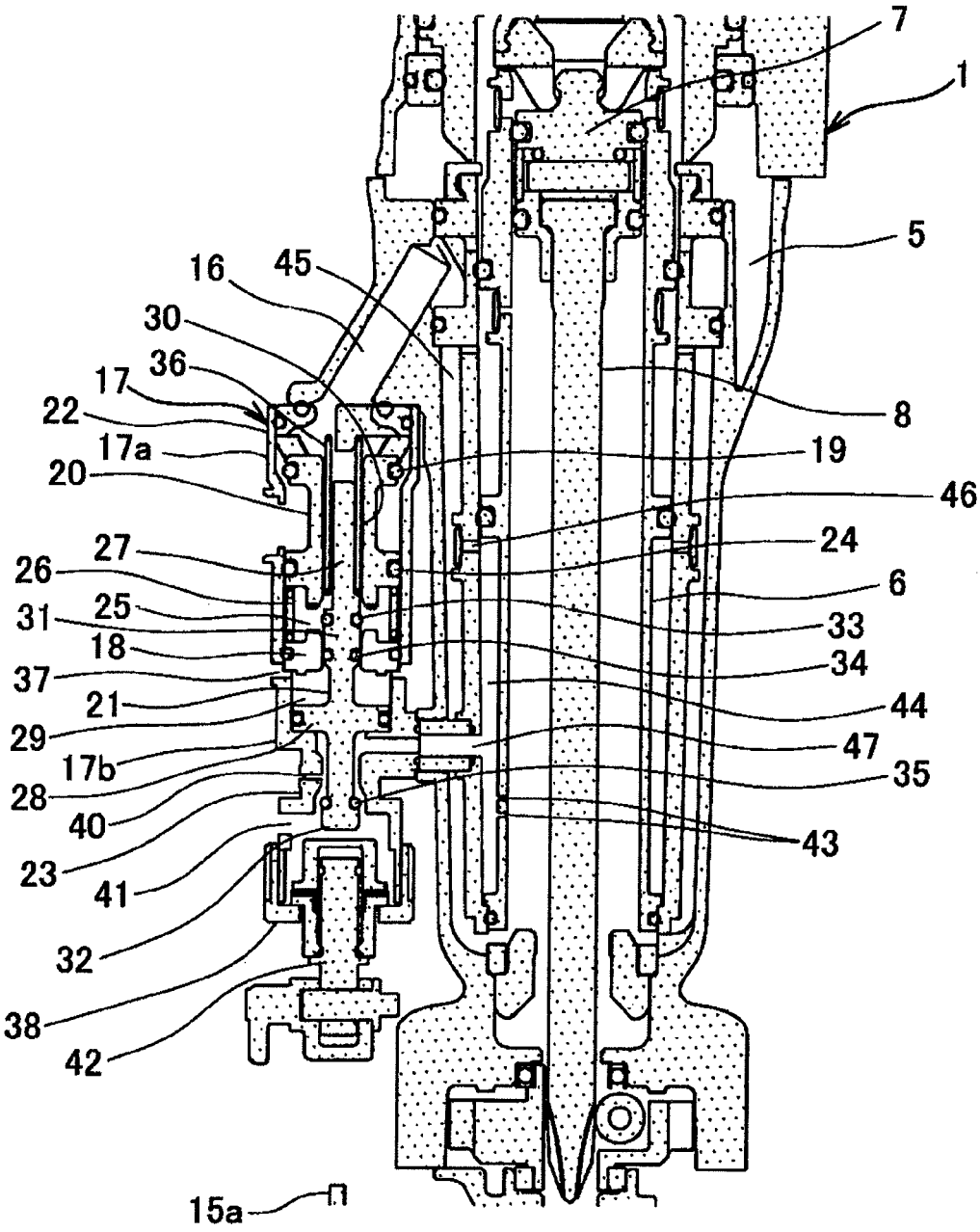
FIG. 2 is a vertical cross-sectional view of an automatic stop mechanism for an air motor.

The automatic stop mechanism for the air motor 12 is constituted by a stop valve provided between the main air chamber 5 and the air motor 12. Namely, as shown in FIG. 2, a valve housing 17 is provided in a midway portion of an air passage 16 leading from the main air chamber 5 to the air motor 12. An upper end of the valve housing 17 is open to the air passage 16 leading to the main air chamber 5. The air passage 16 leads to the main air chamber 5 through the main valve 4.

The valve housing 17 is divided into two parts by an intermediate partition portion 18. A stop valve piston 20 and a stop valve stem 21 are respectively disposed in an upper housing 17*a* and a lower housing 17*b* so as to be slidable coaxially. An upper end portion of the upper housing 17*a* is slightly enlarged in diameter to form a large-diameter portion 22. A lower portion of the lower housing 17*b* is narrowed down to form a small-diameter portion 23.

The stop valve piston 20 is formed in a tubular shape, and O-rings 19 and 24 are fitted at upper and lower ends of the stop valve piston 20. A diameter of the upper O-ring 19 is smaller than an inside diameter of the large-diameter portion 22 of the upper housing 17*a*, but is greater than an inside diameter of a lower end of the large-diameter portion 22. Accordingly, the stop valve piston 20 is downwardly movable within the range in which the upper O-ring 19 is slidable inside the large-diameter portion 22. The stop valve piston 20 operates so as to open the air passage 16 during its upper movement and to close the air passage 16 during its downward movement. The stop valve piston 20 is urged upward by a first spring 26 provided in a valve lower chamber 25 of the valve housing 17. In its urged stated, the stop valve piston 20 keeps the air passage 16 open, as shown in FIG. 2.

The stop valve stem 21 is formed by a rod-like portion 27 and a piston portion 28. The rod-like portion 27 is inserted in a central hole 30 of the stop valve piston 20 with allowance. An intermediate upper portion 31 of the rod-like portion 27 is formed with a slightly large diameter and is slidably inserted in a central hole of the partition wall 18. Further, a bulged projecting portion 32 of a slightly large diameter is formed at a lower end of the stop valve stem 21. O-rings 33, 34, and 35 are respectively fitted to upper and lower portions of the intermediate upper portion 31, the piston portion 28 and the bulged projecting portion 32. The stop valve stem 21 is constantly urged downward by a second spring 36. In addition, an air efflux port 37 is formed in an upper chamber 29 of the piston portion 28 of the lower housing 17*b*.

A first pipeline 40 and a second pipeline 41 leading to the hammering cylinder 6 are respectively formed at upper and lower positions in a lower portion of the lower housing 17*b*. The first pipeline 40 is penetratingly formed in the small-diameter portion 23. The second pipeline 41 is open below the small-diameter portion 23. In this configuration, the second pipeline 41 and the first pipeline 40 are sequentially closed when the stop valve stem 21 is moved upward from a bottom dead center.

As shown in FIG. 2, the lower portion of the valve housing 17 is open. A valve seat 38 is provided below the valve housing 17, and a pusher 42 is disposed on the valve seat 38 so as to be vertically slidable. An upper surface of the pusher 42 is formed so as to face the lower end of the stop valve stem 21. The lower surface of the pusher 42 is disposed so as to be engageable with an upper end proximal portion 15*a* of the contact arm 15.

Two small holes 43 are penetratingly formed in a lower portion of a side wall of the hammering cylinder 6. The small holes 43 are formed so as to open to the hammering cylinder 6 when the hammering piston 7 reaches the bottom dead center.

A timer chamber 44 of a small volume is formed around an outer periphery of the hammering cylinder 6. A blow-back chamber 45 is formed around an outer periphery of the timer chamber 44. The small holes 43 of the hammering cylinder 6 are open to the timer chamber 44. An upper portion of the timer chamber 44 and the blow-back chamber 45 communicate with each other through a communication hole 46.

An air communication passage 47 is formed between the timer chamber 44 and the lower housing 17*b*. An end portion on the timer chamber 44 side of the air communication passage 47 is open in a vicinity of the small holes 43. An end portion on the valve housing 17 side of the air communication passage 47 is open to the small-diameter portion 23 of the valve housing 17.

Figure 3:
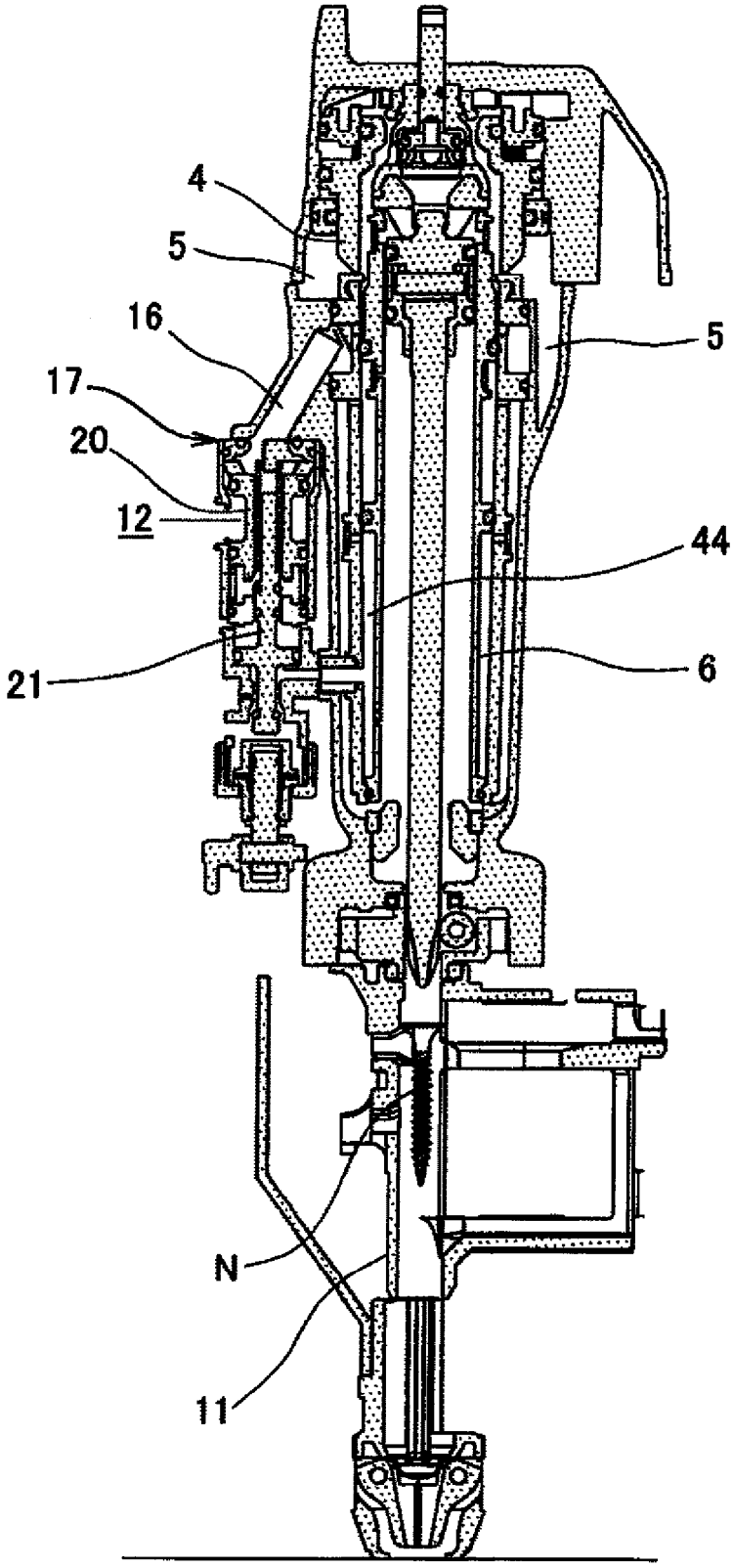
FIG. 3 is a vertical cross-sectional view of the screw driver in an initial state.
Figure 4:
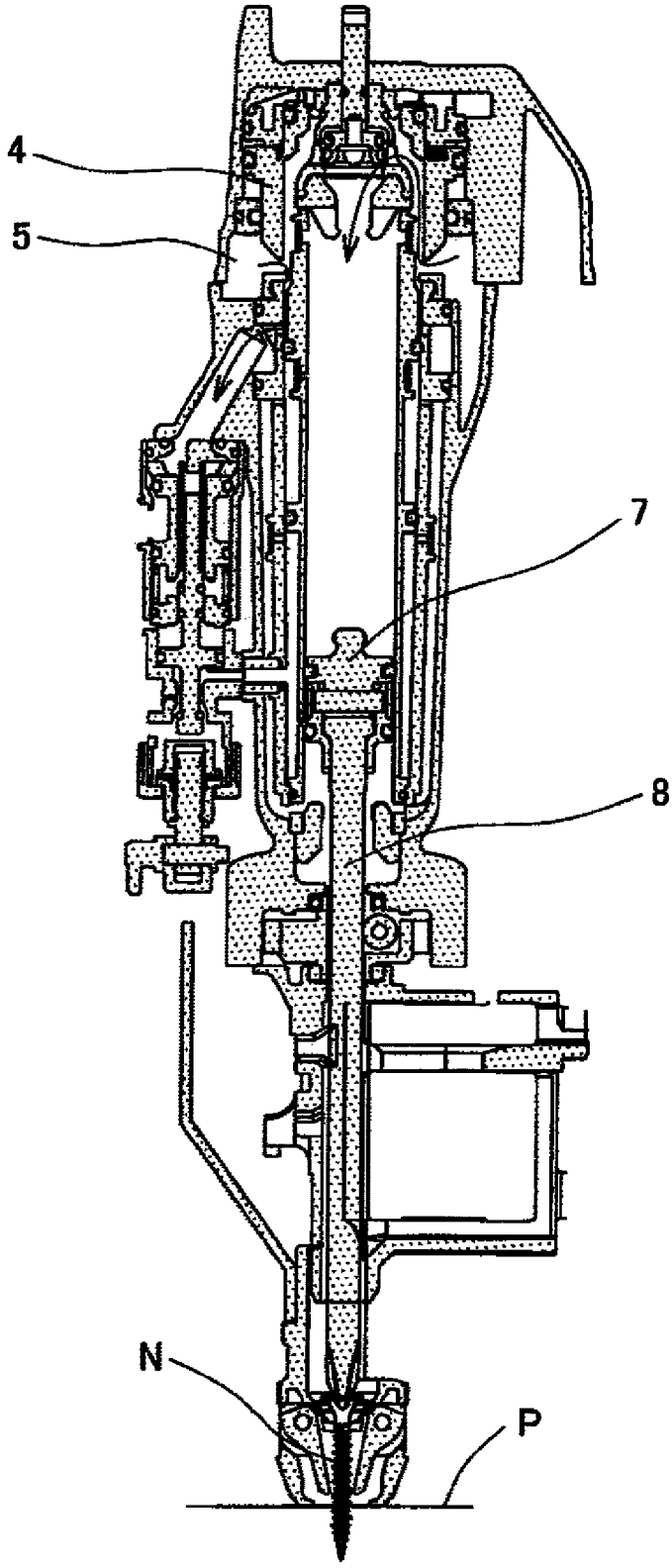
FIG. 4 is a vertical cross-sectional view of the screw driver during a hammering operation.
Figure 5:
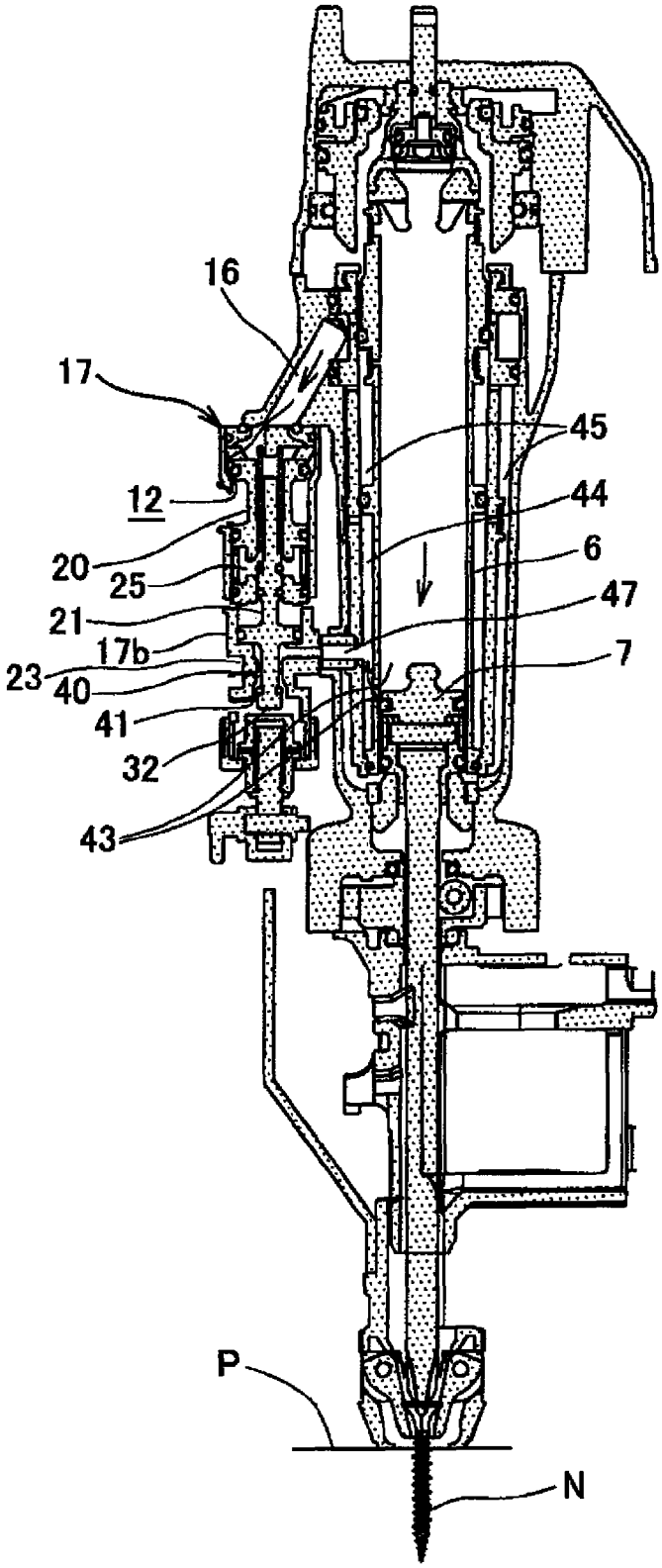
FIG. 5 is a vertical cross-sectional view of the screw driver in a state in which a hammering piston has reached a bottom dead center.

A description will be given of the operation of the automatic stop mechanism having the above-described construction. In an initial state shown in FIG. 3, the drive screw N is supplied into the nose portion 11. The stop valve piston 20 of the stop valve is at the position of the top dead center, while the stop valve stem 21 is at the position of the bottom dead center. When the trigger 2 is operated, as shown in FIG. 4, the main valve 4 undergoes an opening operation to supply the compressed air in the main air chamber 5 into the hammering cylinder 6, thereby causing the driver bit 8 to drive the drive screw N. At this time, a head of the drive screw N is still in a state of floating from a surface of the workpiece P, and the hammering piston 7 is also located at an upper position than the bottom dead center and is urged downward by the compressed air. When the main valve 4 is opened, the compressed air is supplied not only to the hammering cylinder 6 but also to the air passage 16 leading to the air motor 12. At this time, as shown in FIG. 5, since the stop valve piston 20 is open, the compressed air is supplied to the air motor 12. For this reason, the air motor 12 rotates, and a rotational force of the air motor 12 is transmitted to the driver bit 8, thereby causing the driver bit 8 to drive the drive screw N while rotating. Further, when the driver bit 8 is lowered while rotating, and when the hammering piston 7 reaches the bottom dead center, the compressed air in the hammering cylinder 6 flows into the timer chamber 44 from the small holes 43 penetrating the hammering cylinder 6, so that a pressure within the timer chamber 44 increases. A part of the compressed air in the timer chamber 44 is supplied to the blow-back chamber 45. The other part of the compressed air is supplied to the lower housing 17*b* through the air communication passage 47. At this time, the stop valve stem 21 is at the bottom dead center, and a clearance is formed between the bulged projecting portion 32 at the lowermost portion of the stop valve stem 21 and the small-diameter portion 23 of the valve housing 17. For this reason, the compressed air which flowed into the air communication passage 47 flows out to the atmosphere from the first pipeline 40 and the second pipeline 41.

When the air passage 16 leading to the air motor 12 is opened, a part of the compressed air is passed through a clearance between the central hole 30 of the stop valve piston 20 and an upper portion of the stop valve stem 21 and is supplied to the valve lower chamber 25. For this reason, a pressure within that valve lower chamber 25 is increased. Hence, the stop valve piston 20 is prevent from lowering by the compressed air passing through the air passage 16, and the air passage 16 is reliably held in the open state.

Figure 6:
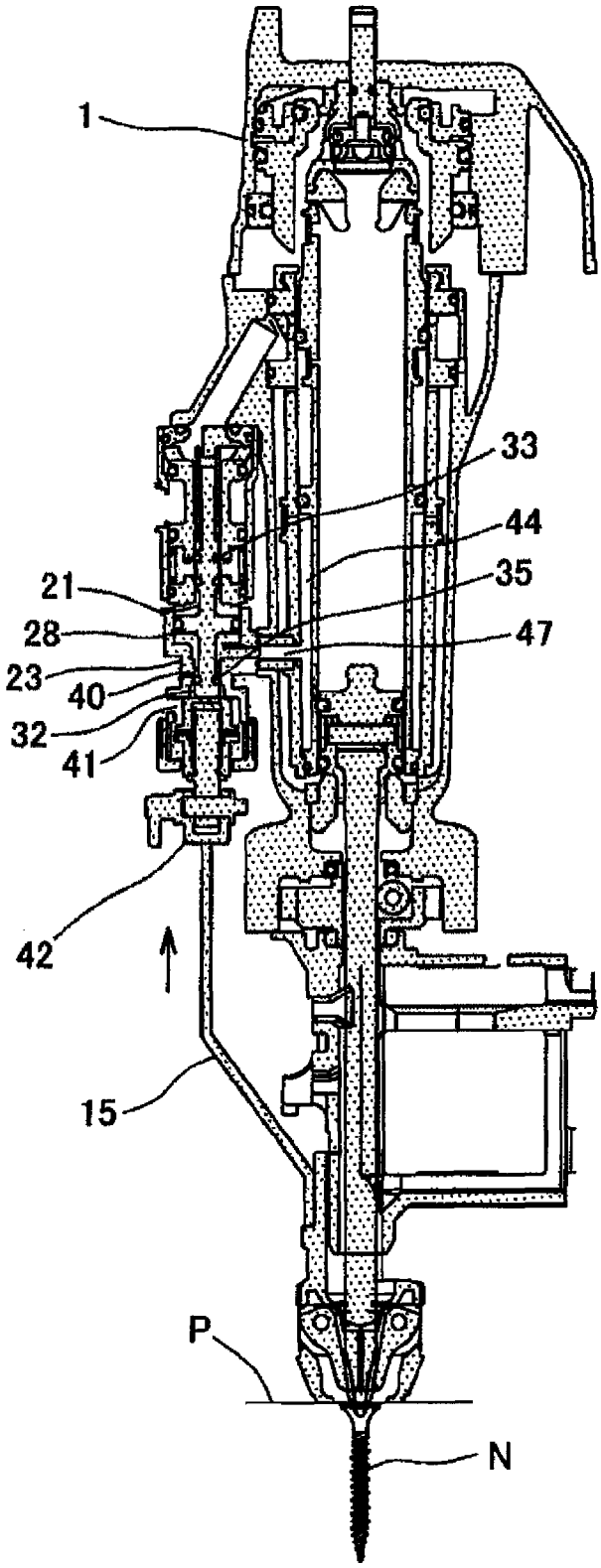
FIG. 6 is a vertical cross-sectional view of the screw driver in a state in which the tightening of a screw has been completed.
Figure 7:
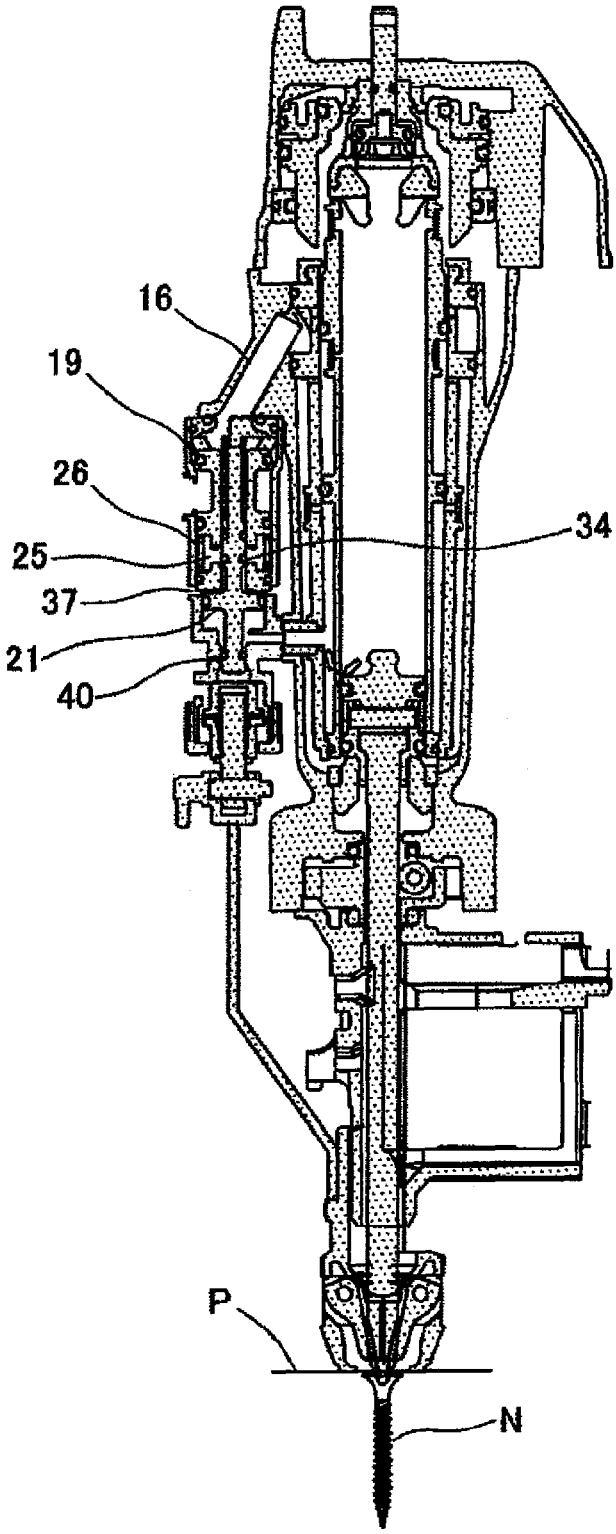
FIG. 7 is a vertical cross-sectional view of the screw driver in a state persisting immediately after the tightening of the screw.

As shown in FIG. 6, when the tool body 1 is lowered in consequence of the tightening of the drive screw N, and reaches the surface of the workpiece P, the contact arm 15 which has been relatively raised with respect to the tool boy 1 reaches the position of the top dead center. Halfway through its course, the contact arm 15 pushes the pusher 42 upward, and the pusher 42 is engaged with and pushes upward the lower surface of the stop valve stem 21 against a spring force of the second spring 36. For this reason, the O-ring 35 of the bulged projecting portion 32 abuts against the small-diameter portion 23 and shuts off the second pipeline 41. As a result, the upper O-ring 33 of the intermediate upper portion 31 of the stop valve stem 21 closes a clearance between the stop valve piston 20 and the rod-like portion 27 of the stop valve stem 21. Although the compressed air in the hammering cylinder 6 leaks only from the first pipeline 40 and is released to the atmosphere, but cannot flow out from the first pipeline 40 alone. For this reason, the pressure within the timer chamber 44 increases, and the pressure with respect to the lower side of the piston 28 of the stop valve stem 21, into which the compressed air from the timer chamber 44 is supplied, also becomes high. As a result, as shown in FIG. 7, the stop valve stem 21 is further raised to shut off the first pipeline 40. Owing to the raising of the stop valve stem 21, a sealing between the O-ring 34 of the intermediate upper portion 31 and the valve lower chamber 25 of the upper housing 17*a* is removed, so that the compressed air within the valve lower chamber 25 flows out to the atmosphere from the air efflux port 37 of the lower housing 17*b*. For this reason, the pressure within the valve lower chamber 25 is reduced to the level of the atmospheric pressure.

Figure 8:
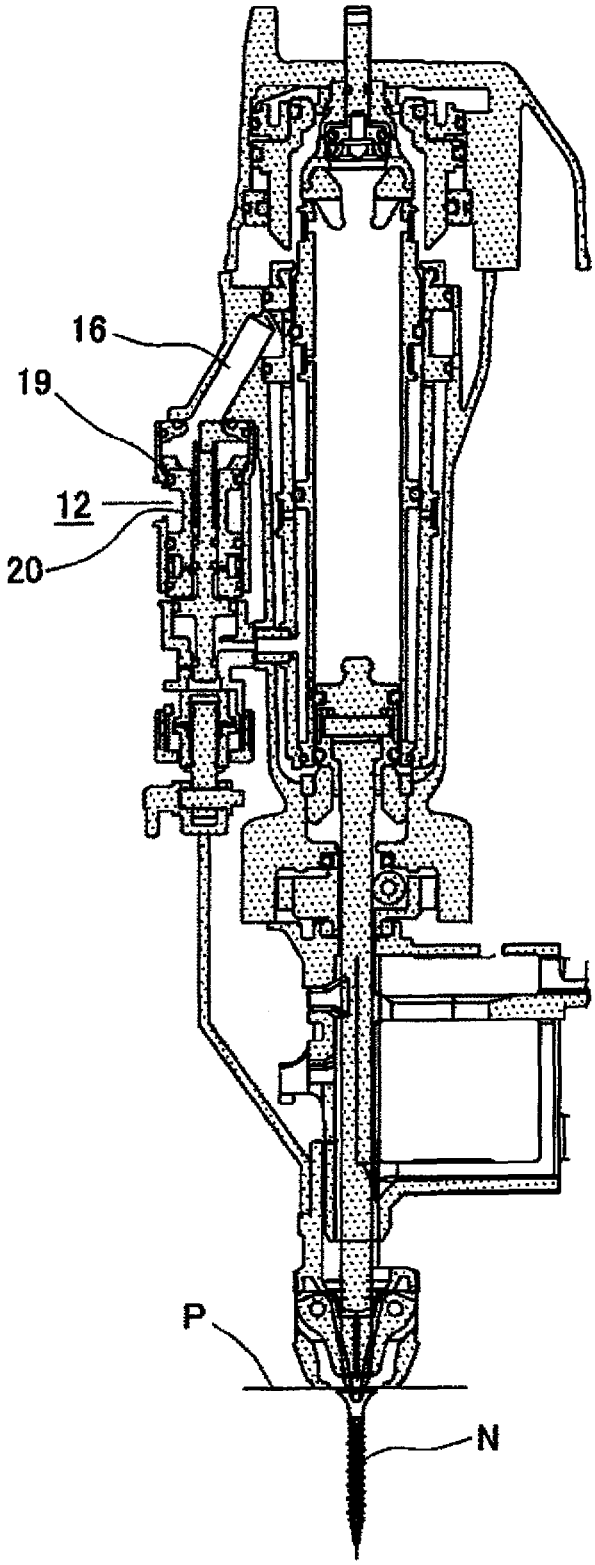
FIG. 8 is a vertical cross-sectional view of the screw driver in a state in which a supply of compressed air to the air motor has been shut off.

When the valve lower chamber 25 assumes the atmospheric pressure, only the first spring 26 urges the stop valve piston 20 upward. For this reason, as shown in FIG. 8, the stop valve piston 20 is lowered by the air pressure within the air passage 16 leading to the air motor 12, thereby shutting off the air passage 16. As a result, since the supply of the compressed air to the air motor 12 is shut off, the air motor 12 stops.

After the stopping of the air motor 12, the trigger 2 is operated so as to close the main valve 4 with respect to the main air chamber 5 and cause the main valve 4 to open to an exhaust port. Then, the compressed air within the hammering cylinder 6 is exhausted, and the hammering piston 7 is returned to the top dead center, and the compressed air in the air passage 16 is also exhausted. For this reason, the stop valve piston 20 and the stop valve stem 21 are also returned to their initial positions by the first spring 26 and the second spring 36, respectively, thereby preparing for a subsequent hammering operation.

As described above, as the tool body 1 is lowered together with the drive screw N in consequence of the screwing-down operation by the air motor 12 after effecting the hammering operation, the contact arm 15 relatively moves upward with respect to the tool body 1. For this reason, the contact arm 15 pushes the pusher 42, thereby causing the pusher 42 to push the stop valve stem 21 upward, and the stop valve stem 21 closes the second pipeline 41. When the hammering piston 7 reaches the bottom dead center after the hammering operation, the compressed air supplied to the first pipeline 40 and the second pipeline 41 from the hammering cylinder 6 through the timer chamber 44 flows out only from the first pipeline 40 since the second pipeline 41 is closed. However, the pressure within the timer chamber 44 and the pressure at the lower portion of the stop valve stem 21 inside the valve housing 17 are increased by the compressed air which cannot flow out fully from the first pipeline 40, with the result that the stop valve stem 21 is moved upward. At this time, in interlocked relation to this upward movement, it becomes possible for the stop valve piston 20 to effect a shutoff operation. For this reason, the stop valve piston 20 is actuated by the compressed air within the air passage 16 to shut off the air passage 16. As a result, the air motor 12 stops its operation.

Thus, a special valve for detecting the pressure increase in the timer chamber 44 is unnecessary by virtue of the construction whereby the stop valve stem 21 is actuated as the pressure within the timer chamber 44 is increased. For this reason, the structure becomes simple, and it becomes possible to reduce the number of parts of the pneumatic screw driver.

The hammering piston 7 reaches the bottom dead center to drive the drive screw N, and the contact arm 15 reaches the top dead center, whereupon the tightening of the drive screw N is completed. When these two conditions are satisfied, the stop valve stem 21 is actuated, and the stop valve piston 20 is actuated in interlocked relation to actuating the stop valve stem 21. For this reason, the top dead center of the contact arm 15 and the bottom dead center of the hammering piston 7 can be detected by the two valves disposed on one axis. Accordingly, the layout of the valves can be made small.

Since the compressed air in the timer chamber 44 is also supplied to the blow-back chamber 45, it is possible to ensure the returning operation of the hammering piston 7 to the top dead center.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A pneumatic screw driver comprising:

a tool body;

a nose portion provided on a leading end of the tool body;

a main air chamber which stores compressed air;

a hammering cylinder provided in the tool body;

a driver bit integrally combined with a hammering piston in the hammering cylinder;

an air motor operated by the compressed air;

a valve housing provided in an air passage between the main air chamber and the air motor;

a stop valve piston provided in the valve housing, the stop valve piston which opens and closes the air passage;

a stop valve stem coaxially provided with the stop valve piston, the stop valve stem which causes the stop valve piston to open and close;

a timer chamber connected to the hammering cylinder;

a first pipeline and a second pipeline respectively formed at upper and lower positions in a lower portion of the stop valve stem; and an upper end proximal portion of a contact member provided slidably in a driving direction in such a manner as to project from the nose portion, the upper end proximal portion provided engageably with the stop valve stem, wherein the first pipeline and the second pipeline are arranged so as to close the first pipeline after closing the second pipeline by moving the stop valve stem upward from a bottom dead center, the compressed air from the hammering cylinder is supplied to the first pipeline and the second pipeline through the timer chamber when the hammering piston reaches the bottom dead center during a hammering operation, the tool body is lowered together with a drive screw in consequence of a tightening operation by the air motor after the hammering operation, the contact member is moved upward relative to the tool body to push the stop valve stem upward, thereby closing the second pipeline, and when the stop valve stem is moved upward by the compressed air which cannot flow out fully from the first pipeline, the stop valve piston effects a shutoff operation of the air passage, thereby closing the first pipeline by the compressed air in the air passage.

2. The pneumatic screw driver according to claim 1, wherein a portion of the timer chamber communicates with a blowback chamber for returning the hammering piston to a top dead center.

3. The pneumatic screw driver according to claim 1, wherein the valve housing includes an upper housing and a lower housing, the stop valve piston is provided in the upper housing, the stop valve stem is provide in the lower housing, the timer chamber is connected to the lower housing, and the first pipeline and the second pipeline connect the lower housing to atmosphere.

4. A stop control method for an air motor in a pneumatic screw driver, the method comprising:

providing a valve housing in an air passage between a main air chamber and the air motor:

coaxially providing a stop valve piston and a stop valve stem inside the valve housing, the stop valve piston for opening and closing the air passage and the stop valve stem for causing the stop valve piston to open and close;

forming a first pipeline and a second pipeline respectively at upper and lower positions in a lower portion of the stop valve stem, the first pipeline and the second pipeline connected to a hammering cylinder;

arranging the first pipeline and the second pipeline so as to close the first pipeline after closing the second pipeline when the stop valve stem moved upward from a bottom dead center;

providing engageably an upper end proximal portion of a contact member with the stop valve stem, the contact portion provided slidably in a driving direction in such a manner as to project from a nose portion provided on a leading end of the tool body;

supplying a compressed air from the hammering cylinder to the first pipeline and the second pipeline through a timer chamber when a hammering piston reaches the bottom dead center during a hammering operation;

lowering the tool body together with a drive screw in consequence of a tightening operation by the air motor after the hammering operation;

moving the contact member upward relative to the tool body, thereby pushing the stop valve stem upward;

closing the second pipeline by pushing the stop valve stem upward;

moving the stop valve stem upward by the compressed air which cannot flow out fully from the first pipeline;

closing the first pipeline by operating the stop valve piston with the compressed air in the air passage;

lowering the stop valve piston by the compressed air in the air passage;

shutting off the air passage by a lowering operation of the stop valve piston; and stopping the air motor.

* * * * *